United States Patent [19]

Kubsik et al.

[11] Patent Number: 5,016,429

[45] Date of Patent: May 21, 1991

[54] APPARATUS FOR DEHEADING WRAPPED PAPER ROLLS

[75] Inventors: Robert H. Kubsik, West Bloomfield; Mir Q. Ali, Troy, both of Mich.

[73] Assignee: Jervis B. Webb Company, Farmington Hills, Mich.

[21] Appl. No.: 529,190

[22] Filed: May 25, 1990

[51] Int. Cl.[5] ..... B65B 69/00; B26D 5/34

[52] U.S. Cl. ..... 53/381.1; 83/211; 83/425.4; 83/364; 83/368; 414/412

[58] Field of Search ..... 83/82, 100, 167, 211, 83/214, 368, 364, 370, 267, 425.4; 53/381 R, 520, 522; 414/412

[56] References Cited

U.S. PATENT DOCUMENTS

| | | | |
|---|---|---|---|
| 3,213,731 | 10/1965 | Renard | 83/211 X |
| 3,741,060 | 6/1973 | Owen | 83/368 |
| 4,070,939 | 1/1978 | Neumeister | 83/368 |
| 4,572,044 | 2/1986 | Antonissen | 83/364 X |
| 4,901,611 | 2/1990 | Bentley | 83/368 X |
| 4,929,141 | 5/1990 | Keesey et al. | 53/381 R X |

*Primary Examiner*—Horace M. Culver

*Attorney, Agent, or Firm*—Joseph W. Farley

[57] ABSTRACT

Apparatus for automatically deheading wrapped newsprint rolls consists of a framework positioned above a pair of rotatable rollers adapted to support and rotate the newsprint roll. Two carriages are slidably supported on the framework above the newsprint roll. Each carriage is independently movable axially relative to one of the opposite end faces of the roll, is provided with an annular locating member engageable with that end face, and has a radially movable cutter adapted to sever the head wrapping covering that end face as the newsprint roll is rotated by the supporting rollers. The annular locating member is mounted obliquely relative to the newsprint roll axis to compensate for deformation of the newsprint roll end face.

8 Claims, 6 Drawing Sheets

APPARATUS FOR DEHEADING WRAPPED PAPER ROLLS

SUMMARY OF THE INVENTION

This invention relates to improvements in a deheading apparatus for removing from a wrapped cylindrical roll of paper the portions of the wrapping, called "heads", that cover the opposed circular end faces of the paper roll; and, for deheading and separating two half-length paper rolls that have been encased in end-to-end relation within a single protective wrapping.

The term "paper roll", or "roll" as used herein is intended to apply to a newsprint roll or to a roll of other sheet material. Such paper rolls are conventionally covered by their manufacturer with a wrapping for the protection of the roll during its shipment to, and until the time of its use by, a consumer. This wrapping includes the circular end face covers or heads mentioned above, made of a relatively heavy material such as cardboard, and a sheet of material such as kraft paper applied over the outer cylindrical surface of the paper roll and over at least a portion of the heads. Examples of this wrapping and of apparatus or the application thereof to a paper roll are contained in U.S. Pat. Nos. 4,485,612, 4,534,151 and 4,679,376.

A wrapped paper roll, when used by a consumer, has generally been unwrapped by first deheading or severing the heads from the wrapping. Conventionally, this operation is performed at a deheading station provided with a pair of parallel powered rollers on which the wrapped roll is placed with its cylindrical peripheral surface supported by the powered rollers. An operator at the deheading station manually inserts a cutting knife through the wrapping between one end surface of the paper roll and the head covering it, and activates, through a suitable control device, the powered rollers which then rotate the paper roll supported thereby. After one revolution of the paper roll, a head has been severed from one of its ends, and the operation is then repeated on the opposite one of its ends. In a large newsprint facility consuming numerous newsprint rolls on each press run, the manual deheading operation is relatively time consuming and labor intensive. Automation of the deheading operation is complicated by deformations in the contour of the paper roll end surfaces and heads resulting from the handling of the paper roll from the place of manufacture to the place of use.

In the apparatus provided by the invention for removing from a wrapped cylindrical paper roll the heads covering the opposite circular end faces thereof at a deheading station having roll supporting means for supporting and rotating the paper roll about the longitudinal axis thereof, frame structure is positioned adjacent to the roll supporting means. First and second trackways are carried by the frame structure and extend substantially parallel to the axis of the supported paper roll in spaced relation with the periphery thereof. First and second carriages are respectively supported for movement on the first and second trackways and are respectively provided with first and second locating means engageable with the opposite end faces of the paper roll, and the carriages are respectively movable on the trackways, between disengaged and engaged positions of the locating means and the opposite end faces of the paper roll, by first and second actuating means disposed between the frame structure and the first and second carriages. Each locating means includes a locating member having a roll end face engaging surface which is disposed in oblique, radially spaced relation to the axis of the supported paper roll. First and second cutter means respectively mounted on the first and second carriages and having axially definable cutting positions relative to the first and second locating means are each movable radially of the supported paper roll between clearance and contacting relation to the periphery thereof. When the first and second carriages are moved by their respective actuating means into engagement of their respective locating means with the opposite end faces of the supported paper roll, and their respective cutter means are moved into contact with the periphery thereof, the cutting positions of the cutter means are such as to sever from the paper roll the heads covering the opposite end faces in response to operation of the cutter means and to the rotation of the paper roll by the roll supporting means.

Preferably, the locating member of each of the first and second locating means is an annular member having an inside diameter, an outside diameter approaching the diameter of the paper roll, and the roll end face engaging surface is an annular surface which extends between the inside and outside diameters and tapers from the inside to the outside diameter. This annular member is attached to a plurality of struts extending radially from a hub on a shaft rotatably supported by a bracket, each bracket being carried by the associated one of the first and second carriages. The shaft is positionable in substantially centered alignment with the longitudinal axis of the supported paper roll and in axial angular relation with the longitudinal roll axis. As a result, the annular roll end face engaging surface extends in oblique transverse relation to the longitudinal roll axis. The angular deviation of the axis of the locating member supporting shaft from a coaxial relation with the longitudinal roll axis is on the order of 5°; and, this angular deviation, together with the tapered roll end face engaging surface mentioned above, compensates for deformations of the paper roll end faces from a planar, perpendicular relation of the paper roll end faces with the longitudinal roll axis.

Fluid passages extend through the locating member supporting shaft, hub, and struts from a coupling on the shaft to suction cups on the struts, the coupling being connectable to a suction source. When the first and second carriages have been moved by their respective actuating means into the engaged positions of their respective locating members with the opposite end faces of a paper roll on the supporting rollers and the paper roll is rotated thereby during a deheading operation, the locating members rotate with the rotating paper roll due to their frictional engagement with the end faces. The application of suction to the suction cups also rotating during the deheading operation, causes the severed heads to be retained thereon and to be separated from the paper roll thereby in the ensuing movement of the first and second carriages to the disengaged positions of their respective locating members.

Gripping devices mounted on the frame structure of the apparatus are operable to pickup the severed and separated heads and place them in waste containers.

For newsprint roll deheading application, the apparatus is provided with a roll splitting cutter unit mounted on one of the carriages and positionable axially relative to the locating member thereof so as to be engageable midway between the end surfaces of a wrapped paper roll unit containing two end-to-end half-length newsprint rolls. These two rolls can thus be deheaded and separated in one operation.

Other features and advantages of the invention will appear from the description to follow of the embodiment thereof shown in the accompanying drawings.

DETAILED DESCRIPTION OF THE INVENTION

Figure 1:
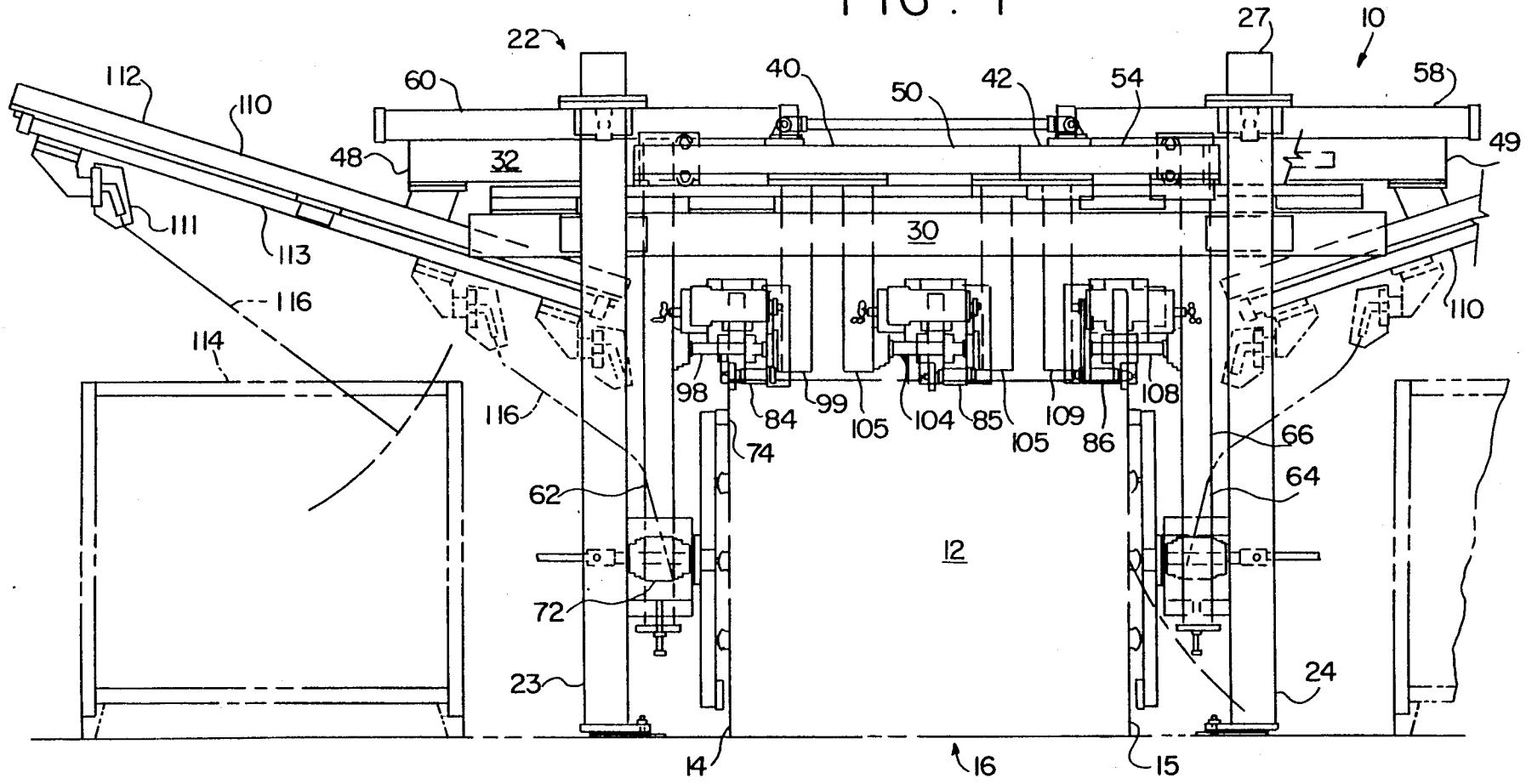
FIG. 1 is a side elevation of a paper roll deheading apparatus of the invention.
Figure 2:
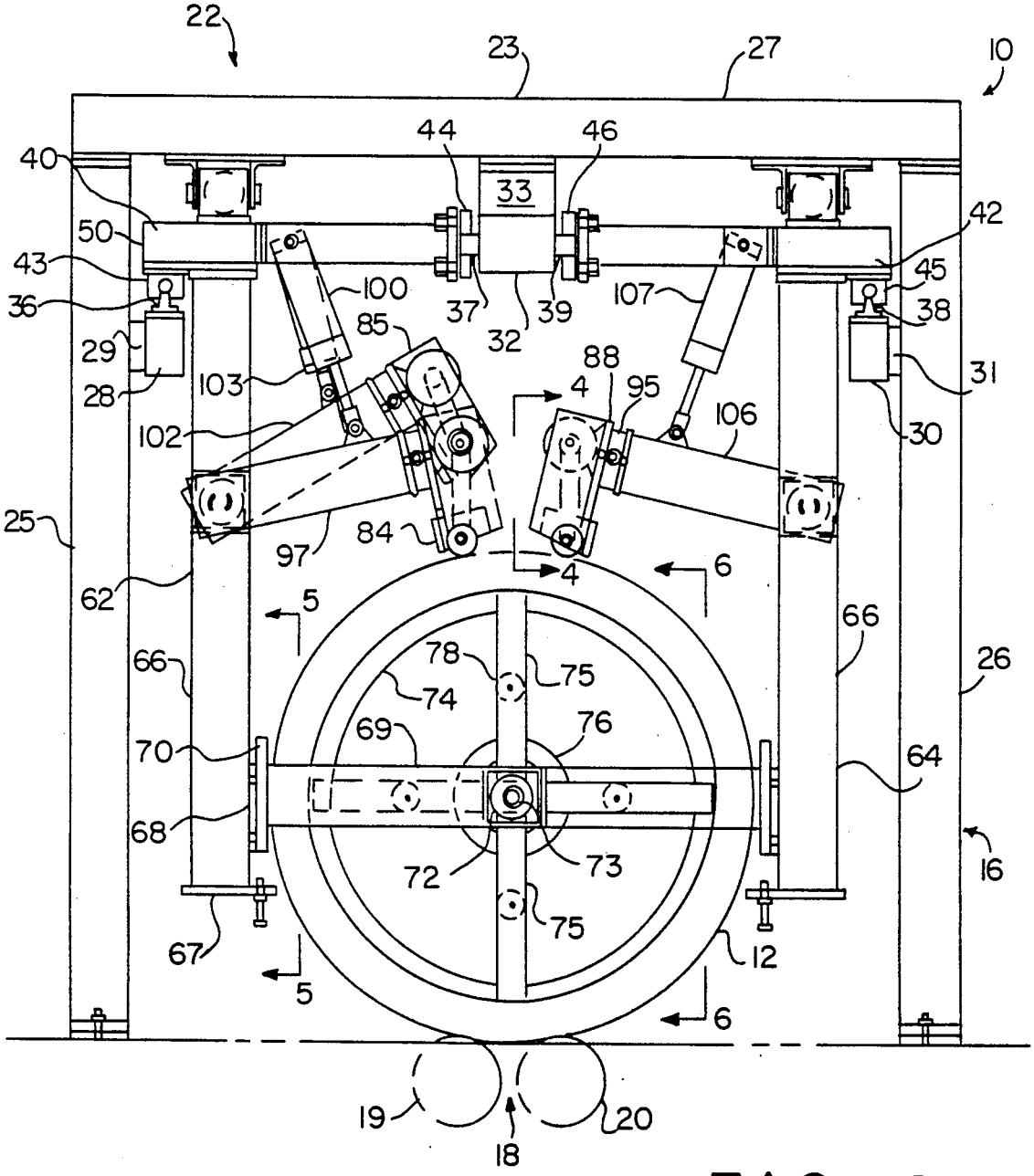
FIG. 2 is an end elevation of the apparatus of FIG. 1.
Figure 3:
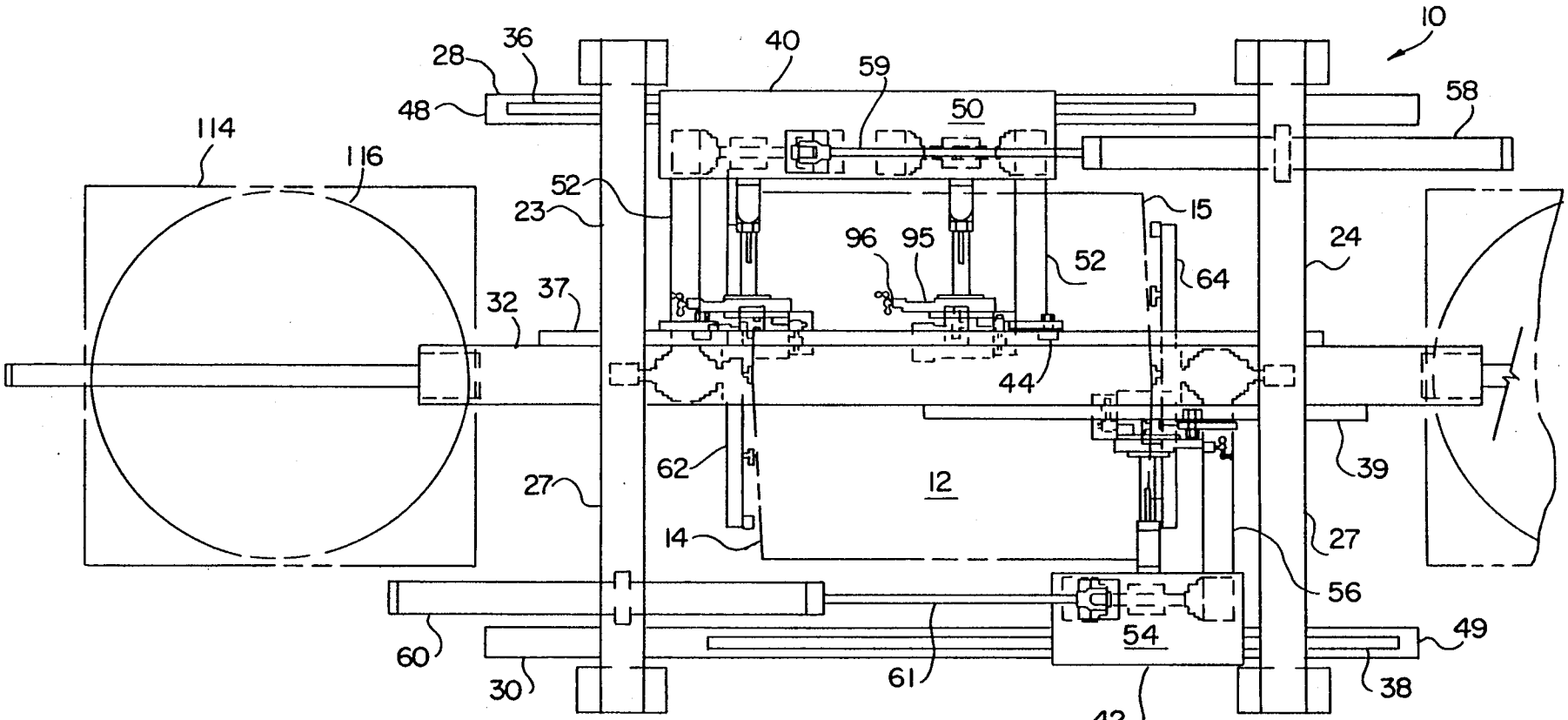
FIG. 3 is a top plan view of the apparatus of FIG. 1.

FIGS. 1-3 show the overall construction of an apparatus 10 of the invention for deheading a wrapped cylindrical paper roll 12 having a longitudinal axis and a pair of oppositely facing, generally circular end surfaces 14 and 15 each covered with a protective head conventionally made of heavy paper board, the entire roll and heads being wrapped in kraft paper. The apparatus 10 is installed at a deheading station 16 provided with paper roll supporting means 18 such as the pair of rollers 19 and 20 (FIG. 2) which are connected to a suitable drive unit (not shown) for rotating the paper roll 12 about its longitudinal axis.

The apparatus 10 comprises frame structure 22 formed by two end frames 23 and 24 each having a pair of upright frame members 25 and 26 connected at their upper ends to a transverse frame member 27; by a first longitudinal frame side member 28 connected to each of the upright end frame members 25 through a spacer 29; by a second longitudinal frame side member 30 connected to each of the upright end frame members 26 through a spacer 31; and by a center longitudinal frame member 32 connected to and below each of the transverse end frame members 27 by a spacer 33. In general, the arrangement of the foregoing components of the frame structure is such that the upright end frame members 25 and 26 are spaced apart transversely by the end frame member 27 a distance greater than the diameter of the paper roll 12, as shown in FIG. 2; the two end frames 23 and 24 are spaced apart longitudinally by the first, second and center longitudinal frame members 28, 30 and 32 a distance greater than the axial length of the paper roll 12, as shown in FIGS. 1 and 3; and, the first, second and center longitudinal frame members 28, 30 and 32 are located above the upper level of the periphery of the paper roll 12 when supported on the rollers 19 and 20, as shown in FIGS. 1 and 2.

First and second trackways carried by the frame structure 22 extend substantially parallel to the longitudinal axis of the supported paper roll 12 in vertically spaced relation with the periphery thereof, the first trackway being formed by a first track 36 mounted on top of the first frame side member 28 and by a first guide rail 37 secured to the facing side of the center frame member 32. The second trackway comprises a second track 38 mounted on the top of the second frame side member 30 and a second guide rail 39 secured to the side of the center frame member 32 facing the frame member 30. As best shown in FIG. 3, the first track 36 and guide rail 37 extend to one end 48 of the apparatus and beyond the corresponding end frame 23; the second track 38 and guide rail 39 extend to and beyond the end frame 24 at the opposite end 49 of the apparatus.

First and second carriages 40 and 42 are respectively supported for movement on the trackways, the first carriage 40 having a shoe 43 slidably engaging the first track 36 and guide rollers 44 contacting the first guide rail 37, the second carriage 42 having a shoe 45 and guide rollers 46 engaging the second track 38 and contacting the second guide rail 39, respectively.

More specifically, the first carriage 40 has a lonitudinally extending base portion 50 supported above the first track 36 by the shoe 43 (FIG. 2). Transversely extending members 52 secured to the base 50 at opposite ends thereof carry the guide rollers 44 (FIG. 3). The second carriage 42 is similar but has a longitudinally smaller base 54 supported above the second track 38 by the shoe 45, and a single transverse member 56 carrying the guide rollers 46.

Figure 5:
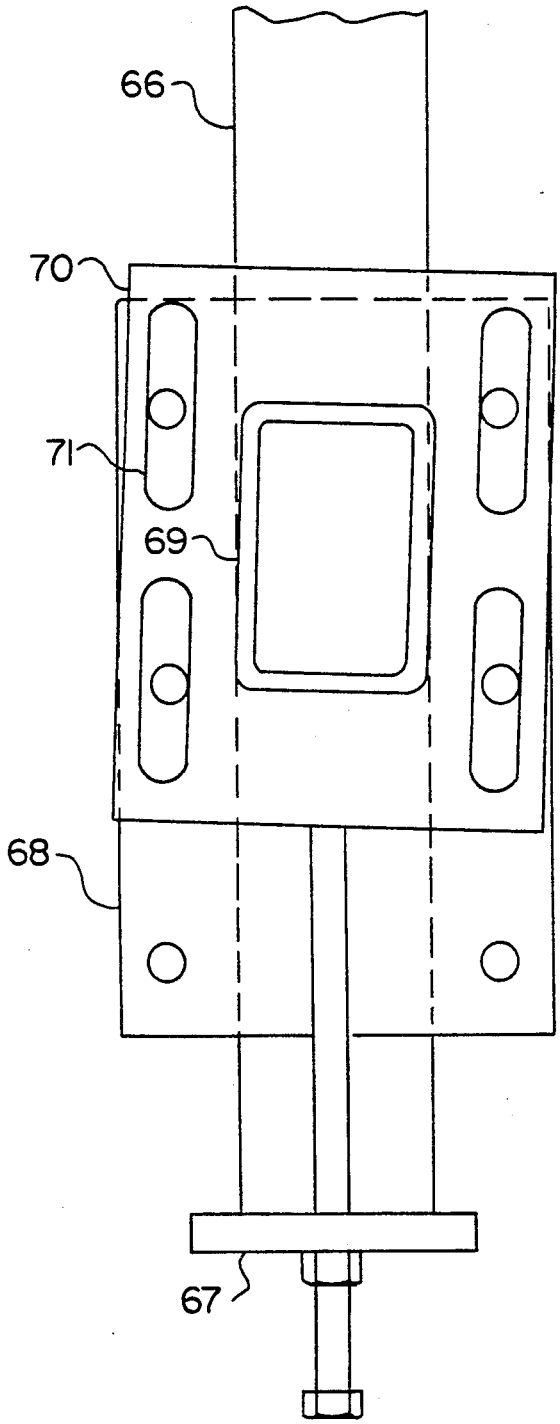
FIG. 5 is an enlarged fragmentary elevation, taken as indicated by the arrows 5—5 of FIG. 2, illustrating the mounting of a roll locating unit; and, FIG. 6 is an enlarged side elevation of the roll locating unit, taken as indicated by the arrows 6—6 of FIG. 2.

A first carriage actuating assembly has a fluid pressure cylinder 58 pivotally suspended from the transverse frame member 27 of the end frame 24, a piston rod 59 connected to the first carriage base 50, and is operable to move the first carriage 40 longitudinally relative to the end 48 of the apparatus. A second, oppositely arranged actuating assembly, operable to longitudinally move the second carriage relative to the end 49 of the apparatus, includes a fluid pressure cylinder 60 suspended from the end frame 23, and a piston rod 61 attached to the base 54 of the second carriage 42. The carriages 40 and 42 are thus independently movable by their respective actuating assemblies with respect to a paper roll 12 that has been positioned on the supporting means when the carriages 40 and 42 have been moved away from each other. Movement of the carriages 40 and 42 toward each other is limited by first and second locating units 62 and 64 which are attached to the respective carriages and which are identical. The locating unit 62 for the first carriage 40 has been shown in detail in FIGS. 5 and 6 and is described below.

Figure 6:
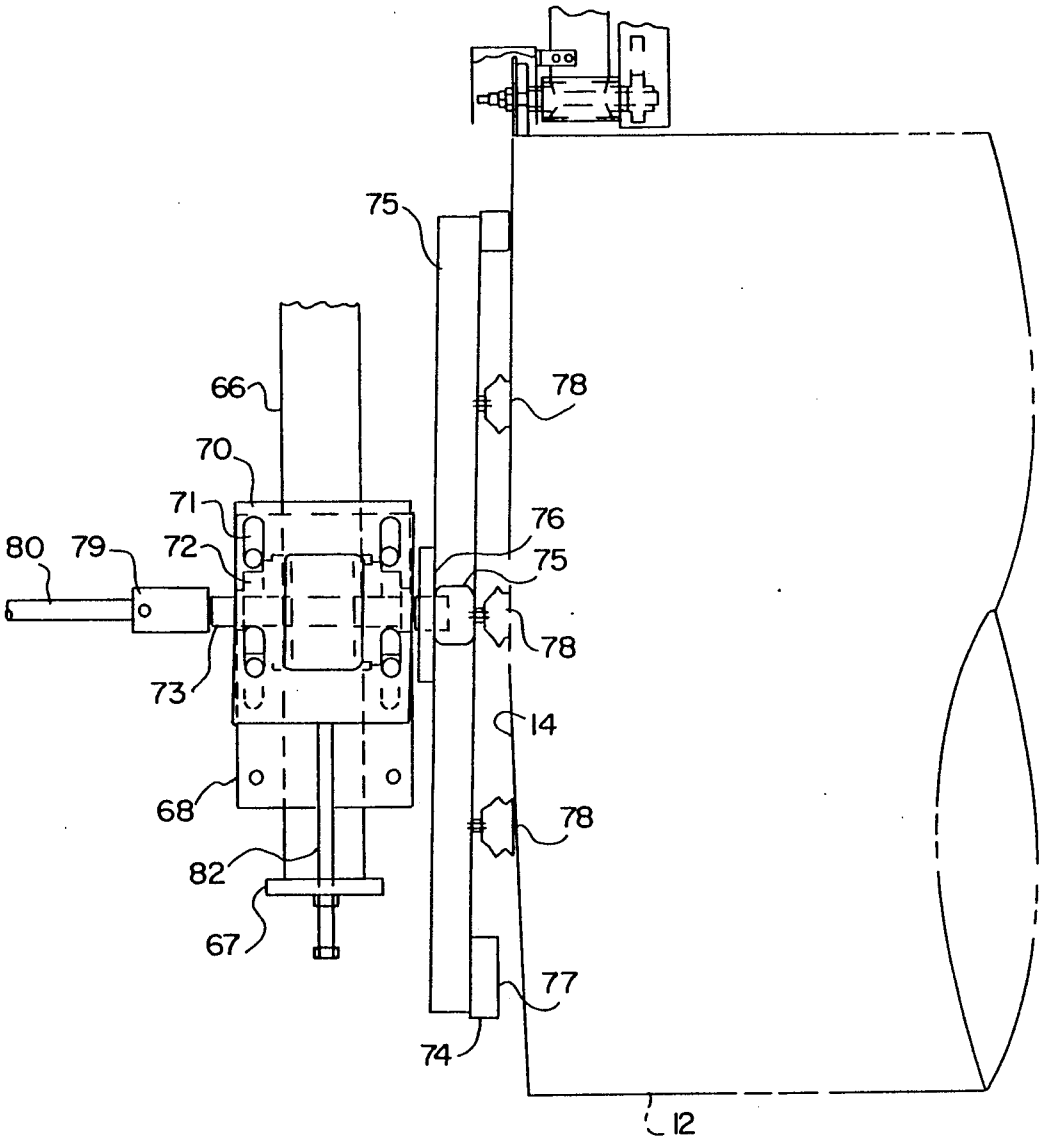

A strut 66 depending vertically from the first carriage base 50 adjacent to the end 48 of the apparatus is equipped at its lower end with a foot pad 67 and a mounting bracket 68. A horizontally extending arm 69 is adjustably attached to the mounting bracket 68 by a plate 70 provided with slots 71 (FIG. 6) which are inclined to a vertical reference line at an angle of about 5°. Carried by the free end of the arm 69 is a bearing 72 for a shaft 73 which rotatably supports an annular locating member 74 mounted on spokes 75 extending radially from a hub 76 attached to the shaft 73. As shown in FIG. 6, the annular member 74 has a roll engaging face 77 which is tapered or beveled from the inside to the outside diameter of the annular member. The spokes 75 and the shaft 73 are tubular and are interconnected through the hub 76 so as to provide inner, fluid tight passages extending from suction cups 78 fitted on the spokes through the spokes 75, the shaft 73 and a coupling 79 to a suction hose 80. Axial alignment of the shaft 73 and the longitudinal axis of a paper roll 12 is provided for by a vertical adjusting screw 82 extending between the foot pad 67 and the plate 70 on the horizontal bracket arm 69, and by shims installed as required between the mounting bracket 68 and plate 70.

Figure 4:
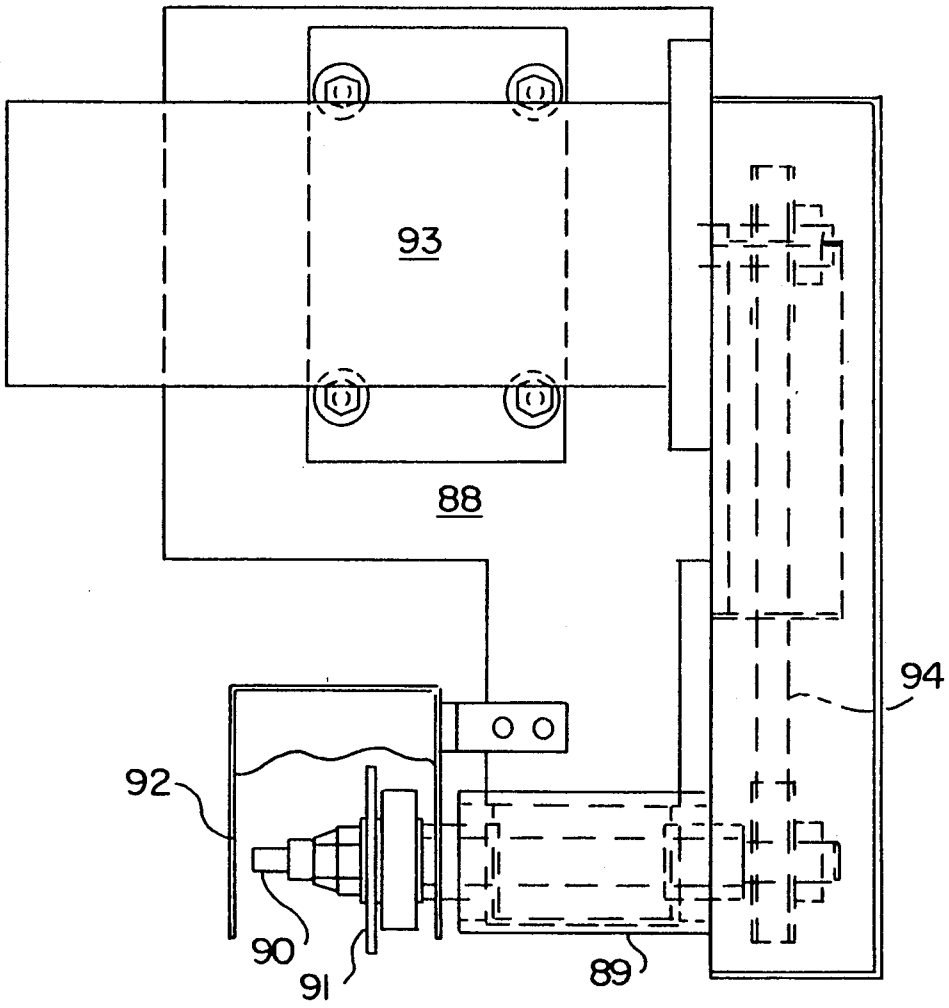
FIG. 4 is an enlarged fragmentary elevation, taken as indicated by the arrows 4—4 of FIG. 2, showing a cutter assembly.

A first head cutter assembly 84 is mounted on the first carriage 40 together with a roll splitting cutter assembly 85; and a second head cutter assembly 86 is mounted on the second carriage 42. Each of these cutter assemblies is similar and includes a platform 88 (FIG. 4) supporting a bearing 89 for a shaft 90 carrying a cutter wheel 91 partially covered by a shield 92, the shaft 90 being driven by a belt drive connection 94 to a motor 93 mounted on the platform 88. Each of the platforms 88 is mounted on a base 95, axially adjustable by a hand wheel 96, and attached to the free end of a pivoted arm movable by a fluid pressure actuator, there being a pivoted arm and a fluid actuator for each of the cutter assemblies.

The first head cutter assembly 84 includes an arm 97 pivoted on a shaft 98 carried between the locating assembly strut 66 and a parallel vertical support 99 attached to the first carriage base 50, the arm 97 being connected to an actuator 100. The roll splitting cutter assembly 85 includes an arm 102 connected to an actuator 103 and pivoted on a shaft 104 carried between parallel vertical supports 105 depending from the first carriage base 50. The second head cutter assembly 86 includes an arm 106 connected to an actuator 107 and pivoted on a shaft 108 carried between a locating means strut 66 and a parallel support 109 depending from the base 54 of the second carriage 42.

A head grip unit 110 is suspended from the center longitudinal frame member 32 at each end of the apparatus and comprises a gripper 111 movable on a track 112 by an actuator 113 between the positions shown at the left hand side of FIG. 1.

In an operating cycle of the apparatus the first and second carriages 40 and 42 are moved apart by their respective actuating cylinders 58 and 60 from the positions shown in FIG. 1 toward the ends 48 and 49 of their respective trackways. The arms of all of the cutter assemblies are raised as shown by the position of the roll splitting cutter assembly arm 102 in FIG. 2. A paper roll 12 is then positioned within the frame structure 22 between the end frames 23 and 24 thereof and is placed on the rollers 19 and 20 of the supporting means 18.

The exact axial location of the paper roll 12 on the supporting means 12 and relative to the end frames 23 and 24 is not critical, since the first and second carriages 40 and 42, when moved toward each other individually by their actuating cylinders 58 and 60, will stop in a position defined the engagement of their respective first and second locating units 62 and 64 with the end surfaces 14 and 15 of the paper roll 12. These end surfaces 14 and 15 of a paper roll 12 that has been wrapped and shipped to a consumer may vary from a true perpendicular plane or relation with the longitudinal axis of the paper roll 12, and may have acquired a deformation such as illustrated in FIG. 6 by the conically convex end surface 14 (which would be accompanied by a conically concave deformation of the opposite end surface 15).

Compensation for such end surface deformations is provided for in the present invention by the vertically inclined angular mounting of the shaft 73 supporting the annular locating member 74, by the beveled roll end surface engaging face 77 of the locating member 74, and by providing the locating member 74 with a diameter approximately that of the paper roll 12. Consequently, a portion of the roll end surface 14 or 15 spaced radially from the longitudinal roll axis is engaged by a portion of the engaging face 77 extending in transverse oblique relation to the longitudinal axis of the paper roll.

After the end surfaces of the paper roll 12 have been thus engaged by the locating units 62 and 63, the supporting rollers 19 and 20 are driven to rotate the roll 12 on its longitudinal axis. If only a deheading operation is to be performed, the driven cutter wheels 91 of the first and second cutter assemblies 84 and 86, which have been axially prepositioned respectively relative to the first and second locating units 62 and 64, are moved from a clearance to a contacting relation with the periphery of the rotating paper roll 12 and the heads covering the ends thereof are severed. Frictional engagement of the locating members 74 with the paper roll end surfaces, causes the locating members and associated suction cups 78 to rotate with the paper roll; and, as the heads are severed, suction is applied through the hoses 80 causing the severed heads to be held on the suction cups. The carriages 40 and 42 are moved apart, the severed heads can then be engaged by the grippers 111 and are deposited thereby in trash containers 114, as indicated by the broken line showing of severed heads 116 in FIG. 1.

Paper rolls for the newsprint industry are supplied in different axial lengths known as full, three-quarters and one-half length; and, two half-length rolls are frequently wrapped together as one double roll. When such a wrapped double roll is placed in the apparatus 10, the splitting cutter assembly 85 is activated to sever the wrapping and separate the two half rolls during the deheading operation.

We claim:

1. Apparatus for deheading a wrapped cylindrical paper roll, having a longitudinal axis and a pair of oppositely facing generally circular end surfaces each covered with a head at a deheading station provided with supporting means for rotating said paper roll about said longitudinal axis, said apparatus comprising:

frame structure positioned at said station in fixed relation with said roll supporting means, said frame structure including a trackway extending substantially parallel to the longitudinal axis of a paper roll positioned on said supporting means and in spaced relation with the periphery of said paper roll;

a carriage supported by said frame structure for movement on said trackway, and actuating means interposed between said carriage and said frame structure for moving said carriage axially relative to said paper roll;

locating means attached to said carriage for defining the axial positioning of said carriage relative to said paper roll, said locating means including a locating member disposed in facing relation with one of said head covered paper roll end surfaces and extending in transverse oblique relation to said longitudinal axis, said locating member being engageable with a portion of said one head covered end surface spaced radially from said longitudinal axis in response to axial movement of said carriage by said actuating means;

cutter means mounted on said carriage for movement between clearance and contacting relation with the periphery of said paper roll, and means for defining an axial cutting position of said cutter means relative to said locating means whereby the head covering the end surface of said paper roll engaged by said locating head is severable in response to movement of said cutter means to said contacting relation and in response to rotation of said paper roll by supporting means.

2. Apparatus according to claim 1 wherein said locating member comprises an annular member, mounting means for attaching said annular member to said carriage with the center of said annular member substantially aligned with said longitudinal axis, said annular member having an outside diameter, an inside diameter and a roll engaging face tapering from said inside to said outside diameter, said outside diameter approaching the diameter of said paper roll.

3. Apparatus according to claim 2 wherein said mounting means includes a hub disposed centrally of said annular member, a plurality of struts attached to and extending between said hub and annular member, a shaft fixed to said hub and extending therefrom oppositely to said roll engaging face of said annular member, and bracket means for supporting said shaft.

4. Apparatus according to claim 3 wherein said shaft and struts are provided with interconnected fluid passages, and suction cup means carried by said struts in communication with said fluid passages for engaging the header severed by said cutter means.

5. Apparatus according to claim 4 further comprising grip means carried by said frame structure for removing a severed head from said suction cup means, said grip means being movable axially and radially relative to a head engaged by said suction cup means.

6. Apparatus according to claim 1 further comprising a paper roll splitter mounted on said carriage in axial longitudinally spaced relation to said cutter means, means for independently moving said roll splitter into engagement with and disengagement from the periphery of said paper roll, said roll splitter being axially positionable relative to said locating means so as to be engageable with the periphery of a wrapped paper contained in one wrapping are separable by said roll splitter.

7. Apparatus for removing from a wrapped cylindrical paper roll the heads covering the opposite circular end faces thereof said apparatus comprising:

roll supporting means for rotating said paper roll about the longitudinal axis thereof, frame structure positioned adjacent to said roll supporting means, trackway means carried by said frame structure and extending substantially parallel to the axis of said supported paper roll in spaced relation with the periphery thereof, first and second carriages supported for movement on said trackway means, said carriages each being provided with locating means for engagement with one of said opposite roll end faces, and first and second actuating means for respectively moving said first and second carriages relative to said supported paper roll between disengaged and engaged positions of said locating means and said opposite roll end faces, said locating means of each of said first and second carriages including a roll end face engaging surface disposed in oblique radially spaced relation to the axis of said supported roll; and first and second cutter means mounted on said first and second carriages respectively, each cutter means having an axially definable cutting position relative to said locating means of its associated carriage and being movable radially of said supported roll into engagement with the periphery thereof in said cutting position, said first and second cutter means being operable in their respective cutting positions to sever from said paper roll the heads covering the opposite end faces thereof in response to rotation of the paper roll by said roll supporting means.

8. Apparatus according to claim 7 wherein said frame structure comprises two end frames spaced apart longitudinally a distance greater than the axial length of said paper roll, each of said end frames having a pair of upright end frame members spaced apart a distance greater than the diameter of said paper roll and connected at their upper ends by a transverse end frame member, first and second longitudinal frame side members and a center longitudinal frame member connecting said end frame members at a vertical level above the upper level of the periphery of a paper roll positioned on said roll supporting means;

said trackway means comprises first and second tracks respectively carried by said first and second longitudinal frame side members, and first and second guides carried by said center longitudinal frame member, said first and second carriages respectively having a base slidably engaging said first and second trackways and having guide rollers carried by said base for engaging said first and second guides.

* * * * *